US011944862B2

(12) United States Patent
Booker

(10) Patent No.: US 11,944,862 B2
(45) Date of Patent: Apr. 2, 2024

(54) MULTIFUNCTIONAL KETTLEBELL EXERCISE DEVICE

(71) Applicant: Toussaint Orfeu Booker, Sylmar, CA (US)

(72) Inventor: Toussaint Orfeu Booker, Sylmar, CA (US)

( * ) Notice: Subject to any disclaimer, the term of this patent is extended or adjusted under 35 U.S.C. 154(b) by 5 days.

(21) Appl. No.: 17/545,539

(22) Filed: Dec. 8, 2021

(65) Prior Publication Data

US 2022/0176185 A1 Jun. 9, 2022

Related U.S. Application Data

(63) Continuation-in-part of application No. 29/802,942, filed on Aug. 9, 2021.

(60) Provisional application No. 63/122,648, filed on Dec. 8, 2020.

(51) Int. Cl.
*A63B 21/072* (2006.01)
*A63B 21/00* (2006.01)

(52) U.S. Cl.
CPC ..... *A63B 21/072* (2013.01); *A63B 21/4035* (2015.10)

(58) Field of Classification Search
CPC ... A63B 21/0552; A63B 21/072; A63B 21/16; A63B 21/4033; A63B 21/4035; A63B 21/4039; A63B 23/1236; A63B 2225/093
See application file for complete search history.

(56) References Cited

U.S. PATENT DOCUMENTS

| | | | | |
|---|---|---|---|---|
| 1,316,683 | A * | 9/1919 | Calvert | A63B 21/072 482/93 |
| 7,976,443 | B2 | 7/2011 | Krull | |
| 8,267,841 | B1 * | 9/2012 | Allison | A63B 21/075 482/106 |
| 8,979,719 | B2 * | 3/2015 | Januszek | A63B 21/072 482/106 |
| 9,770,619 | B1 | 9/2017 | Bullock | |
| 9,844,695 | B1 * | 12/2017 | Shorter | A63B 21/075 |
| 11,433,270 | B2 * | 9/2022 | Boatner | A63B 21/0724 |
| 11,446,537 | B2 * | 9/2022 | D'Alesio | A63B 21/0603 |

(Continued)

FOREIGN PATENT DOCUMENTS

CN 202859996 U 4/2013

OTHER PUBLICATIONS

Gofit Contour Kettlebell, Retrieved from Internet, Retrieved on Aug. 31, 2020 <URL: https://www.scheels.com/p/gofit-contour-kettlebell/68733962100.html>.

*Primary Examiner* — Joshua Lee

(57) ABSTRACT

A multifunctional kettlebell device is a uniquely designed kettlebell that can assist with a plurality of exercises. To accomplish this, the device includes loops and rings that may be attached to other equipment and accessories such as resistant bands, backpack straps, additional weights, or of the likes. Further, the device has a flat front and rear surface to prevent any bulgy uncomfortable force pushed against the body of the user when lifting the kettlebell. In addition to the flat surface, the device includes a unique indentation that assists with maintaining proper body posture and weight distribution while the invention is being used. Thus, the multifunctional kettlebell device is an exercise equipment with plurality of accessory attachment provisions, as well as a convenient and user-friendly shape.

19 Claims, 14 Drawing Sheets

(56) References Cited

U.S. PATENT DOCUMENTS

| | | | | |
|---|---|---|---|---|
| 11,491,361 | B2 * | 11/2022 | Flick | A63B 21/072 |
| 2004/0005970 | A1 | 1/2004 | Anderson | |
| 2004/0048724 | A1 | 3/2004 | Wang | |
| 2010/0120588 | A1 * | 5/2010 | Krull | A63B 21/0728 482/93 |
| 2011/0306475 | A1 * | 12/2011 | Caswell | A63B 21/4035 482/93 |
| 2013/0012367 | A1 | 1/2013 | Williams | |
| 2013/0040789 | A1 * | 2/2013 | Kessler | A63B 21/072 482/108 |
| 2013/0085045 | A1 | 4/2013 | Chavez et al. | |
| 2013/0157815 | A1 | 6/2013 | Reynolds | |
| 2015/0105224 | A1 * | 4/2015 | Odneal | B22D 17/00 164/47 |
| 2015/0231440 | A1 | 8/2015 | Nelson | |

* cited by examiner

MULTIFUNCTIONAL KETTLEBELL EXERCISE DEVICE

FIELD OF THE INVENTION

The present invention relates to an exercise equipment. More specifically, the present invention is a uniquely designed kettlebell that can assist in a plurality of exercises.

BACKGROUND OF THE INVENTION

In recent years, there has been an increase in the number of people that are considered physically active. The number of physically active people across the world will continually increase as it plays an integral part of a healthy lifestyle. In addition, there also has been an increased emphasis placed on physical fitness and rehabilitation along with many different types of exercise equipment and devices available for such purposes. During an exercise or rehabilitation, it is important to get the proper equipment and movement for the body for an exercise to be effective. Many people make the simple mistake of misusing equipment or misdirect body movements during an exercise due to equipment being unfitting, too heavy, bad posture, or of the likes.

An objective of the present invention is to provide a uniquely designed kettlebell device, that can assist with a plurality of exercises. In other words, the present invention is a multifunctional kettlebell with a unique design compared to existing kettlebells. More specifically, the present invention comprises loops and rings to attach to other equipment such as resistant bands, backpack straps, additional weights, or of the likes. Furthermore, the present invention has a flat front and rear surface to prevent any bulgy uncomfortable force pushed against the body of the user when lifting the kettlebell. In addition to the flat surface, the present invention comprises a unique indentation that assists with maintaining proper body posture and weight distribution while the invention is being used. Thus, the present invention is a multifunctional kettlebell device with a plurality of accessory attachment provisions, as well as a convenient and user-friendly shape.

DETAIL DESCRIPTIONS OF THE INVENTION

Figure 1:
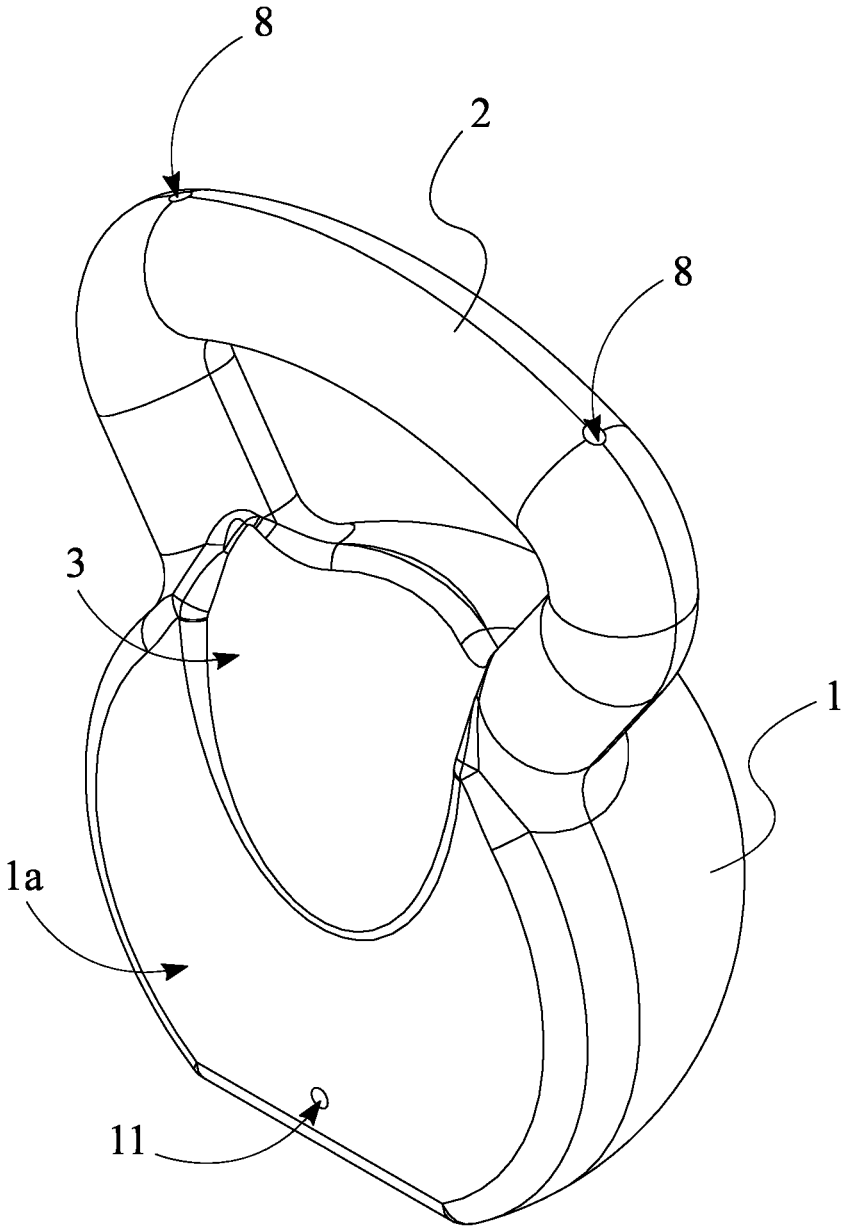
FIG. 1 is top-rear-left perspective view of the present invention without any fastening attachment.
Figure 2:
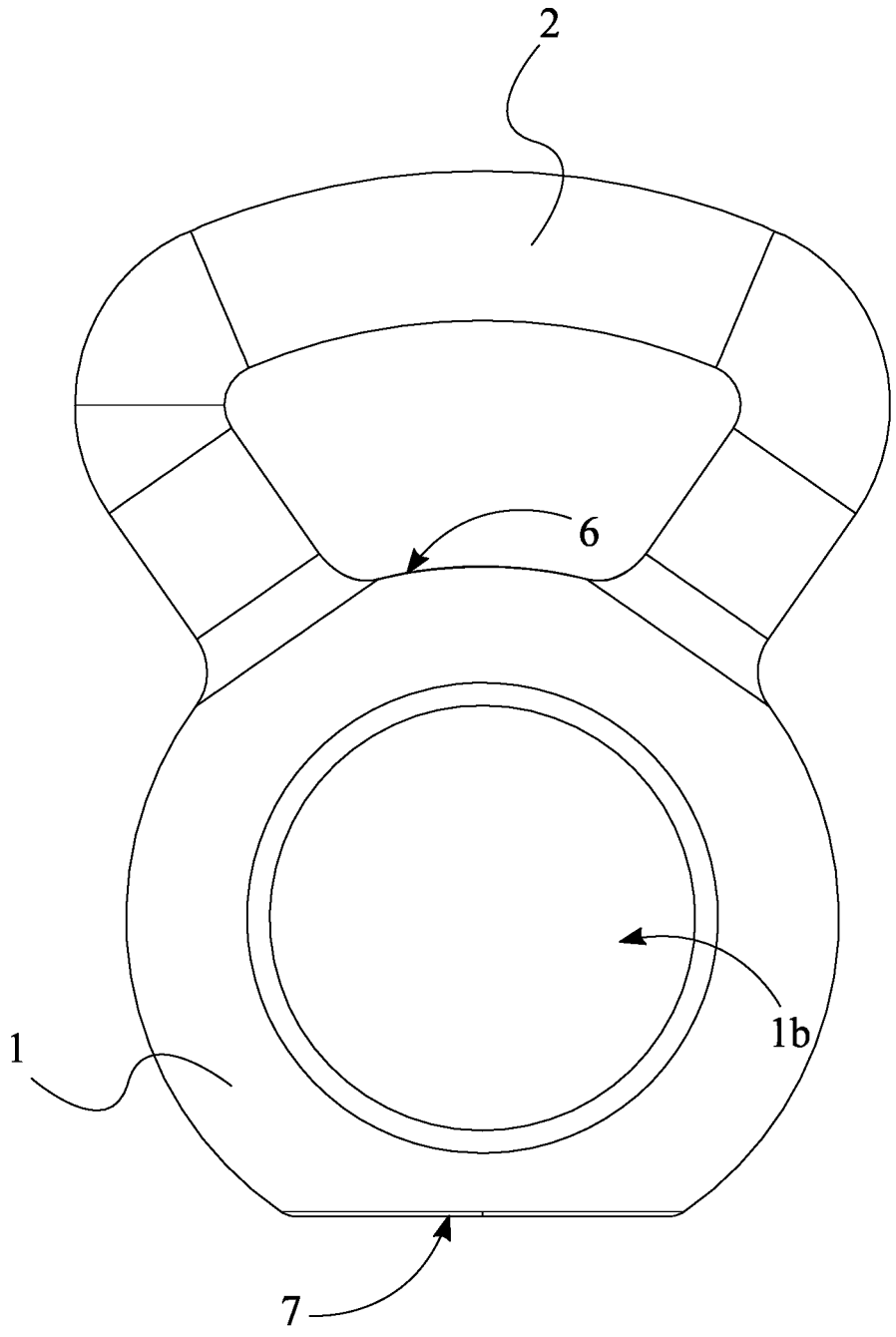
FIG. 2 is a front elevational view of the present invention without fastening attachments.

All illustrations of the drawings are for the purpose of describing selected versions of the present invention and are not intended to limit the scope of the present invention.

In reference to FIG. 1 through FIG. 14, the present invention is a multifunctional kettlebell device. An objective of the present invention is to provide a uniquely designed kettlebell device, that can assist with a plurality of exercises. More specifically, the present invention comprises loops and rings to attach to other equipment such as resistant bands, backpack straps, additional weights, or of the likes. Furthermore, the present invention has a flat front and rear surface to prevent any bulgy uncomfortable force pushed against the body of the user when lifting the kettlebell. In addition to the flat surface, the present invention comprises a unique indentation that assists with maintaining proper body posture and weight distribution while the invention is being used. Thus, the present invention is a multifunctional kettlebell device with a plurality of accessory attachment provisions, as well as a convenient and user-friendly shape.

The following description is in reference to FIG. 1 through FIG. 12. According to a preferred embodiment of the present invention, the multifunctional kettlebell device comprises a main body 1, a handle 2, a first indentation 3, a plurality of first fasteners 4, and a plurality of second fasteners 5. Preferably, the main body 1 comprises an iron cast steel ball that is shaped similar to a kettlebell ball. Further, the main body 1 comprises a first surface 1*a* and a second surface 1*b*, wherein the first surface 1*a* is positioned opposite to the second surface 1*b* across the main body 1. In the preferred embodiment, the first surface 1*a* constitutes a rear surface and the second surface 1*b* constitutes a front surface of the main body 1. As seen in FIG. 1 through FIG. 6, the main body 1 is hemispherical. More specifically, lateral sidewalls extending between the first surface 1*a* and the second surface 1*b* have a convex shape. However, the main body 1 may comprise any other material, size, shape, components, arrangement of components etc., that are known to one of ordinary skill in the art, as long as the intents of the present invention are not altered. Furthermore, as seen in FIG. 1 through FIG. 6, the handle 2 is mounted onto a first end 6 of the main body 1, wherein the first end 6 constitutes a top end of the main body. Preferably, the handle 2 is semicircular in shape, comprises the same material as the main body 1, and the handle 2 is wide enough to accommodate two hands of an adult human. However, the handle may comprise any other size, material, shape etc. as long as the objectives of the present invention are fulfilled.

Figure 3:
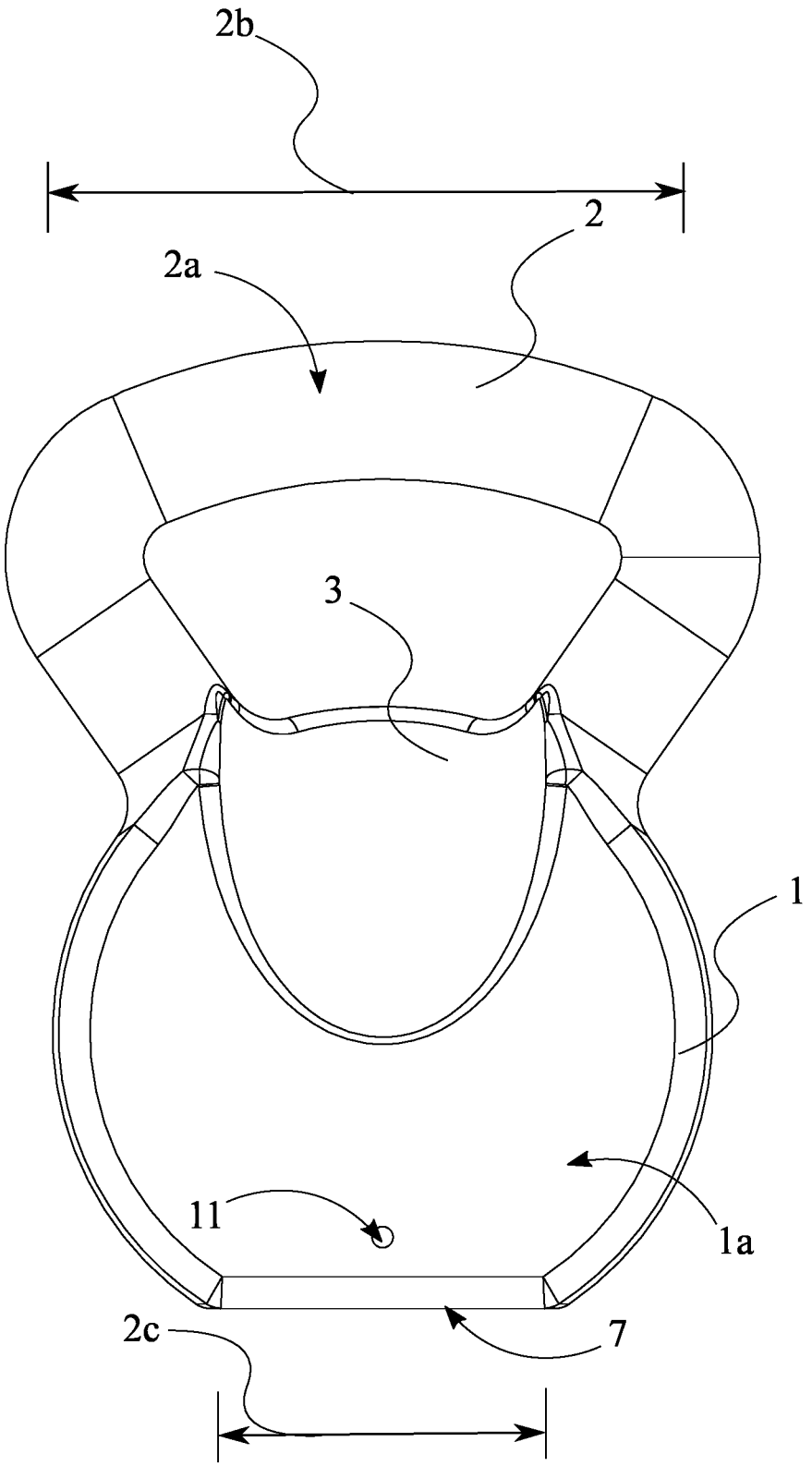
FIG. 3 is a rear elevational view of the present invention without fastening attachments.
Figure 4:
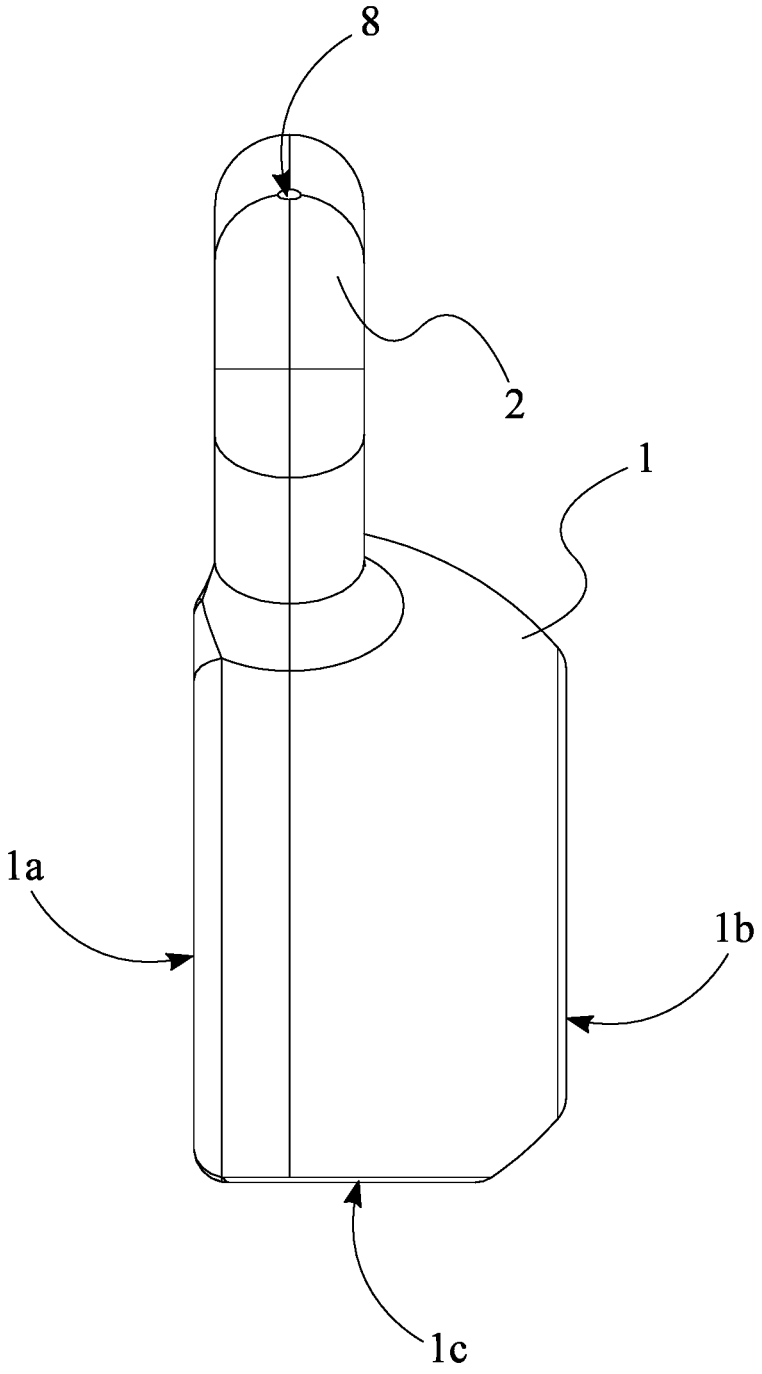
FIG. 4 is a side view of the present invention without fastening attachments.

According to the preferred embodiment, the first indentation 3 tapers from the first end 6 of the main body 1 towards a second end 7 of the main body 1, wherein the second end 7 is positioned opposite to the first end 6 across the main body 1. In the preferred embodiment, the second end 7 constitutes a bottom end of the main body 1. As seen in FIG. 1 and FIG. 3, the rear side of the present invention comprises an angled, curved first indentation 3 that starts at the handle's 2 base and has a continuous flow along its oval path. In other words, the first indentation 3 is positioned on the first surface 1*a* of the main body 1 and in between terminal edges of the handle 2. Preferably, the first indentation 3 on the first surface 1*a* of the kettlebell is designed to distribute weight differently from standard existing kettlebells. The first indentation 3 of the present invention allows weight distribution along the center of mass, that allow users to exercise more efficiently and safely compared to standard existing kettlebells. Further, the present invention distributes its weight directly onto the glute, hamstring adductor, calves, shoulders, back, and bicep muscles by allowing it to stay as close to the user's body as possible when performing certain exercises. Furthermore, the first indentation 3 also enables the user to rest their wrist within the first indentation 3 in a comfortable and ergonomic fashion while using the present invention for certain exercise routines.

In reference to FIG. 3, the handle 2 comprises a gripping portion 2*a*, and the gripping portion 2*a* comprises a first length 2*b*. Further, the second end 7 of the main body comprises a second length 2*c*. Preferably, the first length 2*b* is greater than the second length 2*c*. In other words, according to the preferred embodiment, the handle 2 is wider than the bottom end of the main body 1. This is so that the user may have a more comfortable grip and weight distribution on their hands, while handling the present invention for various exercises.

Figure 5:
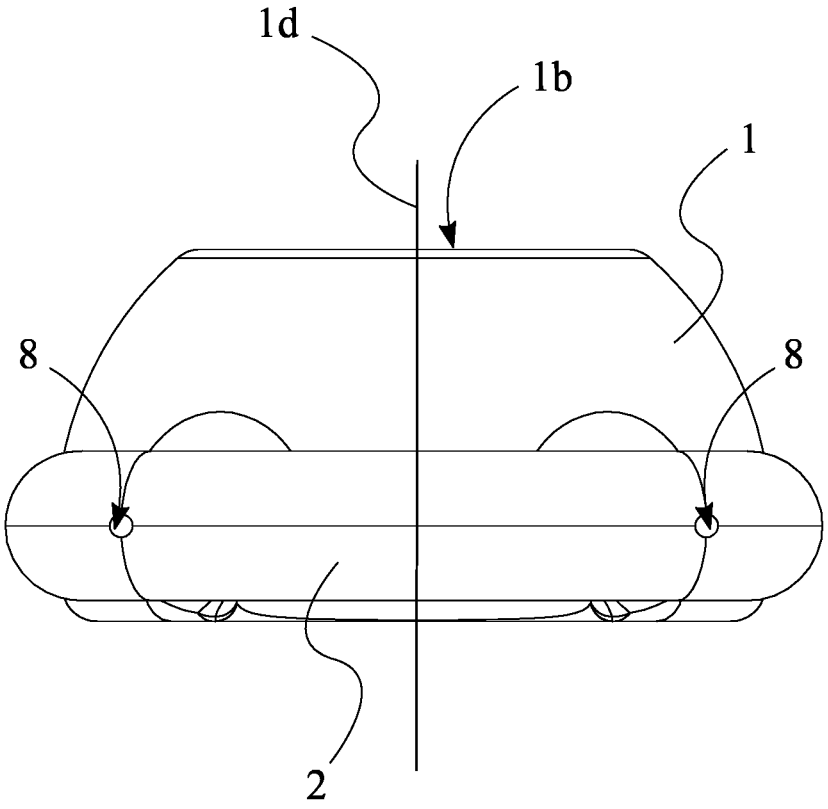
FIG. 5 is a top plane view of the present invention without fastening attachments.
Figure 6:
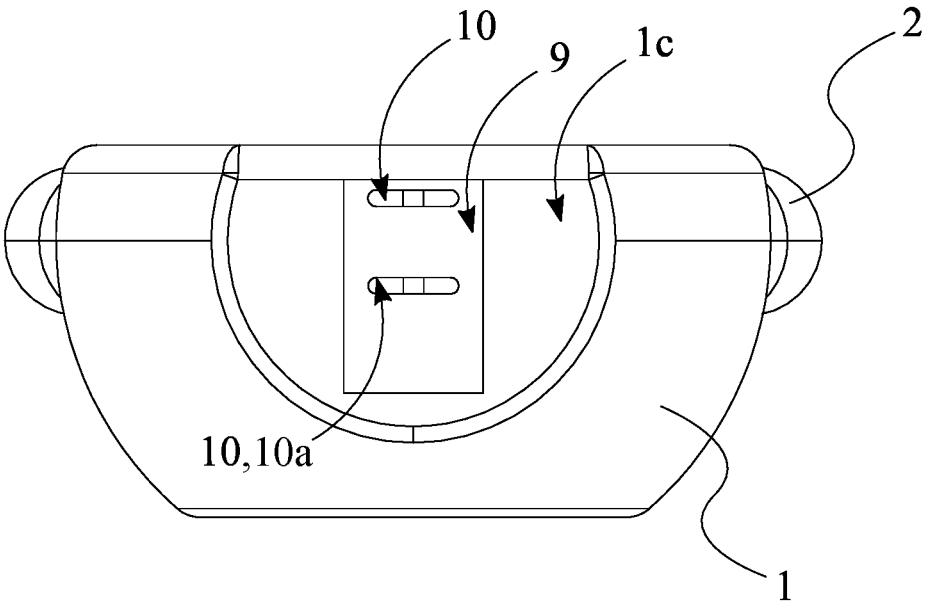
FIG. 6 is a bottom view of the present invention without fastening attachments.
Figure 7:
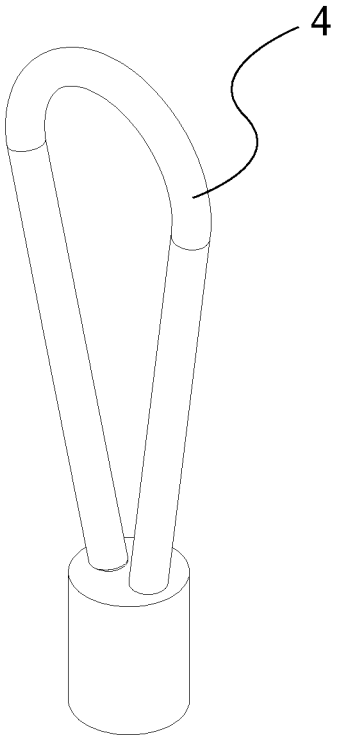
FIG. 7 is an isometric view of an upper fastening attachment of the present invention.
Figure 8:
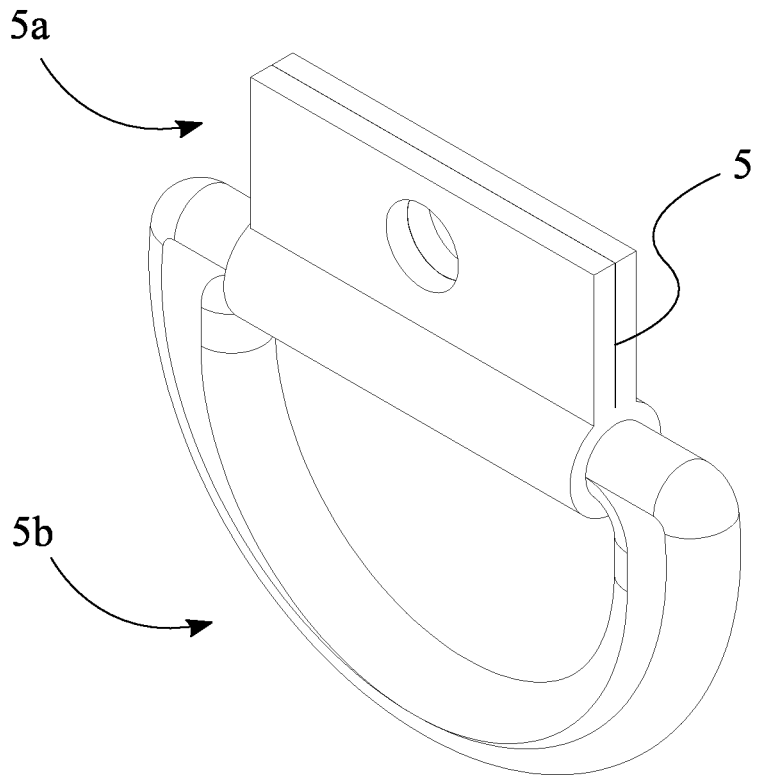
FIG. 8 is an isometric view of a lower fastening attachment of the present invention.
Figure 9:
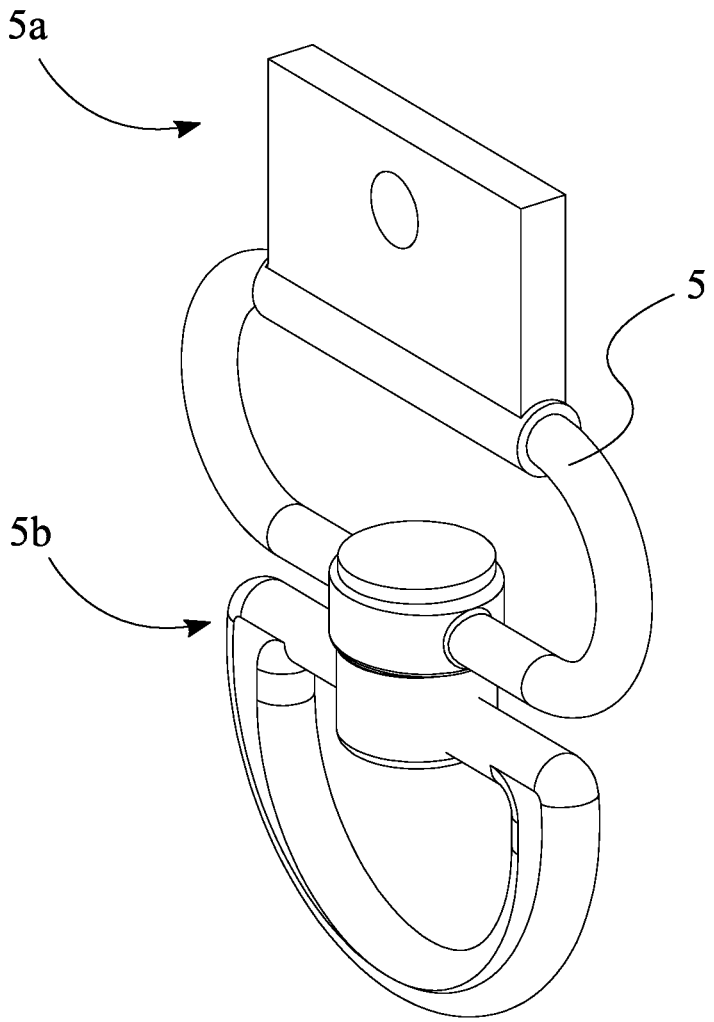
FIG. 9 is an isometric view of an embodiment of the lower fastening attachment of the present invention.
Figure 10:
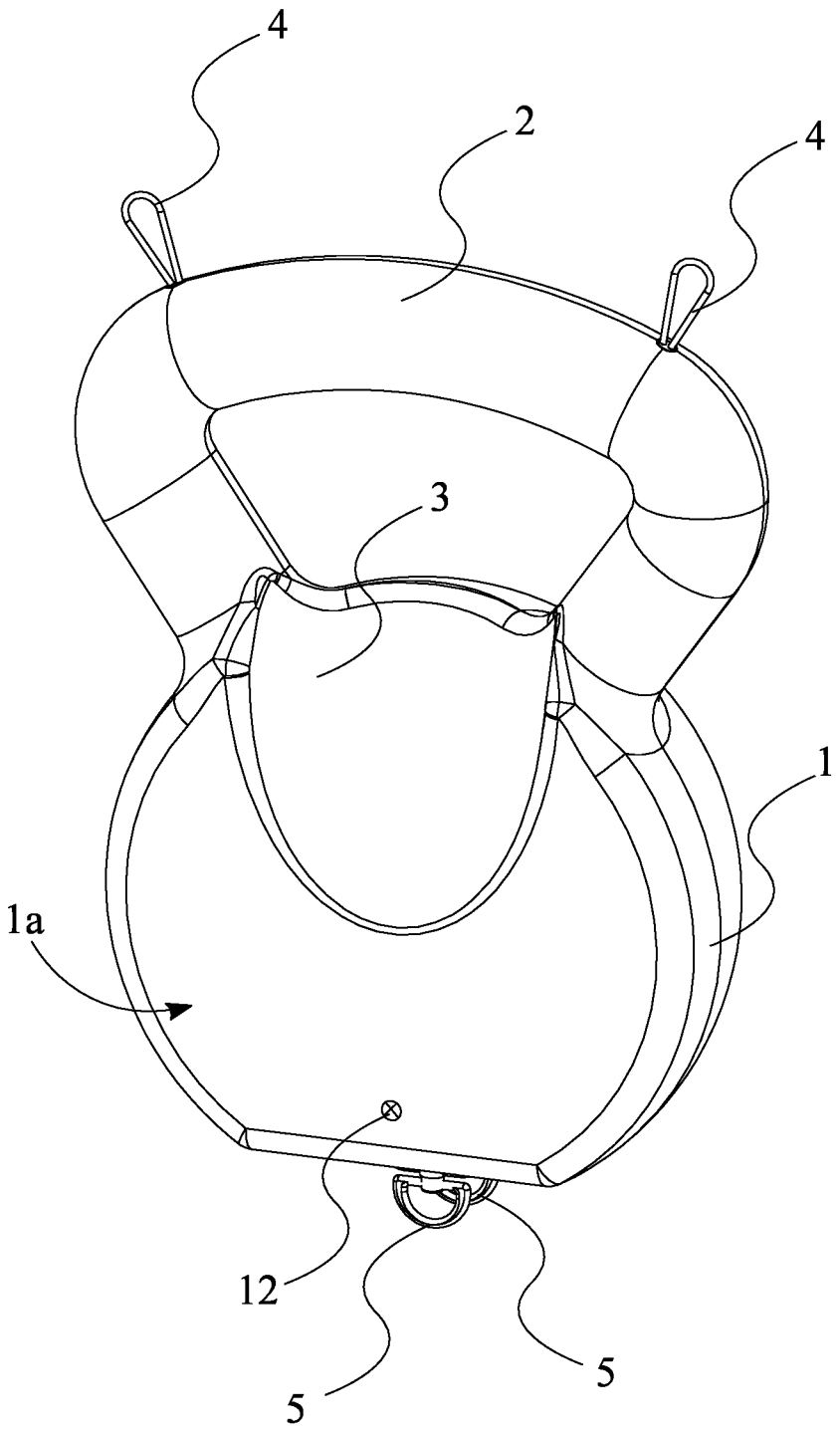
FIG. 10 is a top rear perspective view of the present invention with fasteners attached.

In reference to FIG. 10 through FIG. 14, the plurality of first fasteners 4 is mounted onto the handle 2. Preferably the plurality of first fasteners 4 are fastening attachments that are inserted into the handle 2 of the present invention. As seen in FIG. 7, each of the plurality of first fasteners 4 comprises metal loops. This is so that the metal loop of each of the plurality of first fasteners 4 may act as the accessory attachment through which other exercise equipment such as resistance bands, straps etc. may be threaded. Continuing with the preferred embodiment, the plurality of second fasteners 4 is mounted onto a third surface 1*c* of the main body 1 wherein the third surface 1*c* is positioned adjacent the second end 7 of the main body 1. In the preferred embodiment, the third surface 1*c* constitutes a bottom surface of the main body 1. In other words, the plurality of second fasteners 5 are accessory attachments mounted on the lower surface of the kettlebell. Accordingly, as seen in FIG. 1 through FIG. 6, the first surface 1*a*, the second surface 1*b* and the third surface 1*c* are planar surfaces. As seen in FIG. 8 and FIG. 9, the plurality of second fasteners 5 comprises D-clips or D-shaped rings with a rectangular clip on the straight edge of the D-shape ring. Preferably, the plurality of second fasteners 5 enables users to attach accessories and other fasteners such as harnesses, straps, cords, clips etc. However, the plurality of first fasteners 4 and the plurality of second fasteners 5 may comprise any other size, shape, fastening technology etc., that are known to one of ordinary skill in the art, as long as the intents of the present invention are not altered.

In order to securely attach the plurality of first fasteners 4 onto the handle 2, the present invention comprises a plurality of holes 8. Preferably, the plurality of holes 8 traverses through the handle 2 in such a way that the plurality of first fasteners 4 may be threaded through the plurality of holes 8. To that end, the insertion of the plurality of first fasteners 4 is achieved by being inserted under the handle 2 of the kettlebell through a recessed hole. More specifically, the upper loop attachment of the plurality of first fasteners 4 is inserted on the underside of the handle 2 through the plurality of holes 8 and pushed and pulled upwards so that the loop of each of the plurality of first fasteners 4 is presented on the top side of the handle 2. Each of the plurality of first fasteners 4 has a cylindrical lower base with a loop attachment at the top half as shown in FIG. 7. Note that the cylindrical base can differ in terms of structure as it can be presented as a nail-like structure to twist and fasten onto the handle 2 of the kettlebell. As seen in FIG. 5, the plurality of holes 8 is equidistant from a longitudinal central axis 1*d* of the main body 1. This is so that the present invention provides symmetry and a balance along the center of gravity even when other attachments are threaded through the plurality of first fasteners 4.

Figure 11:
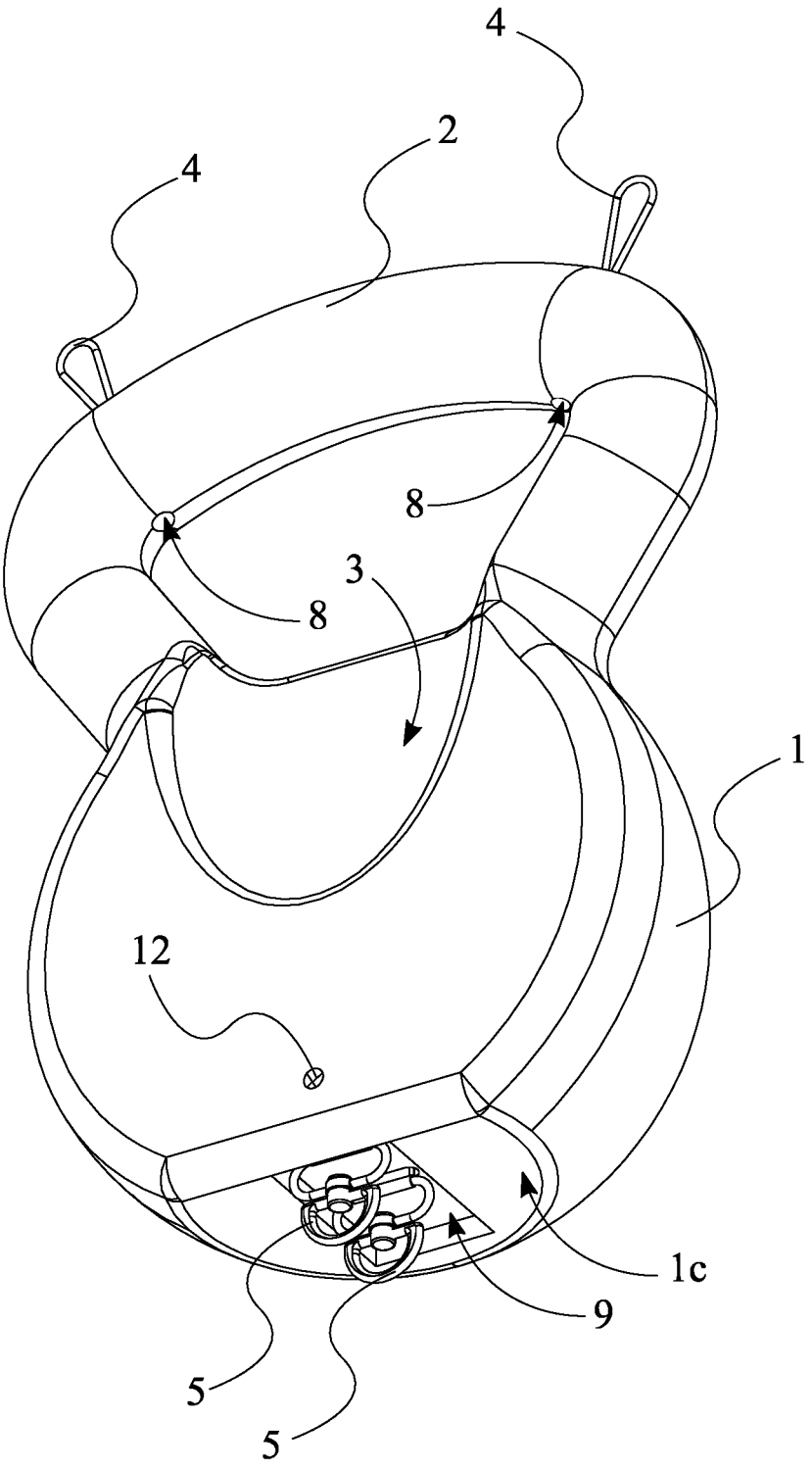
FIG. 11 is a bottom rear perspective view of the present invention with fasteners attached.
Figure 12:
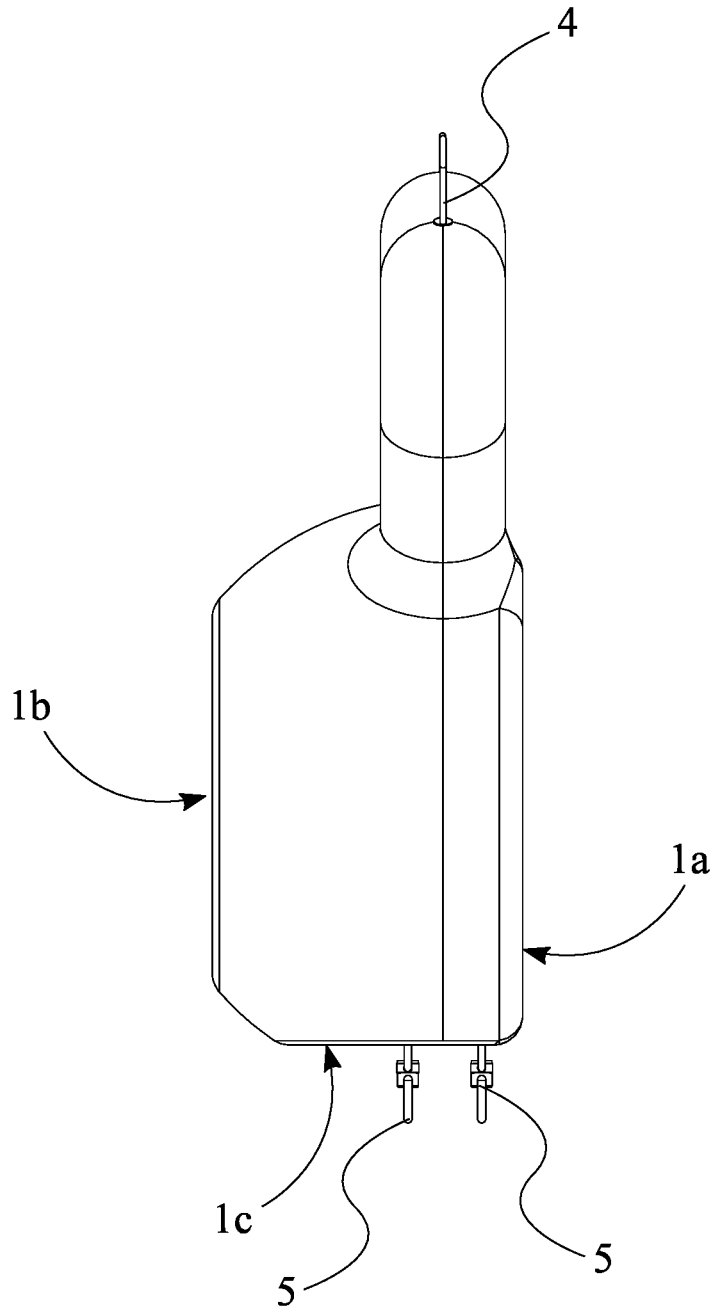
FIG. 12 is a side view of the present invention with fasteners attached.

In order to securely hold and fasten the plurality of second fasteners 5, the present invention comprises a second indentation 9 and a plurality of insertion slots 10. As seen in FIG. 6 and FIG. 11, the second indentation 9 is positioned on the third surface 1*c*. Preferably, the second indentation 9 houses the plurality of second fasteners 5 within the second indentation 9. This is so that, the second indentation 9 allows for the smooth placement of the kettlebell on a horizontal surface, without the plurality of second fasteners 5 protruding out. In the preferred embodiment, the plurality of insertion slots 10 extends into the main body 1 from the second indentation 9 towards the first end 1*a* of the main body 1. More specifically, each of the plurality of second fasteners 5 is inserted and fastened into the rectangular holes or plurality of insertion holes 10 on the bottom face of the kettlebell. As seen in FIG. 8 and FIG. 9, each of the plurality of second fasteners 5 is a D-shaped ring with a rectangular clip on the straight edge of the D-shape ring, and the clip extends opposite to the direction of the ring as it is used to insert into the bottom face of the kettlebell. In other words, a first section 5*a* of each of the plurality of second fasteners 5 is mounted within the plurality of insertion slots 10, and a second section 5*b* of each of the plurality of second fasteners 5 is positioned outside the plurality of insertion slots, wherein the second section 5*b* is positioned opposite to the first section 5*a* across the second fastener 5.

In order to securely fasten the plurality of second fasteners 5 within the main body 1, the present invention comprises a fastener canal 11 and a third fastener 12. As seen in FIG. 1, FIG. 3, FIG. 10, FIG. 11, and FIG. 13, the fastener canal 11 traverses from the first surface 1*a* into the plurality of insertion slots 10, and the fastener canal 11 is positioned adjacent the second end 7 of the main body 1. Preferably, the third fastener 12 is a threaded screw that is threaded through the fastener canal 11. This is so that the third fastener 12 may securely fasten each of the plurality of second fasteners 5 within a corresponding insertion slot 10*a*, and wherein the corresponding insertion slot 10*a* is from the plurality of insertion slots 10. However, the third fastener 12 may comprise any other fastener or fastening technology that is known to one of ordinary skill in the art, as long as the intents of the present invention are not altered.

In reference to FIG. 9, an embodiment of the second fastener 5 is shown. In this embodiment, a lower loop attachment of the second fastener 5 shows a unique swivel design that allow any attachment to the kettlebell to rotate. In other words, the plurality of second fasteners 5 is rotatable. The swivel-assist or rotatability of the second fastener 5 will prevent the development of potential tangles and knots. Further, the swivel design allows a wide range of motion and mobility as the lower loop attachment and the kettlebell can rotate accordingly to any rotational movements created by the user.

Figure 13:
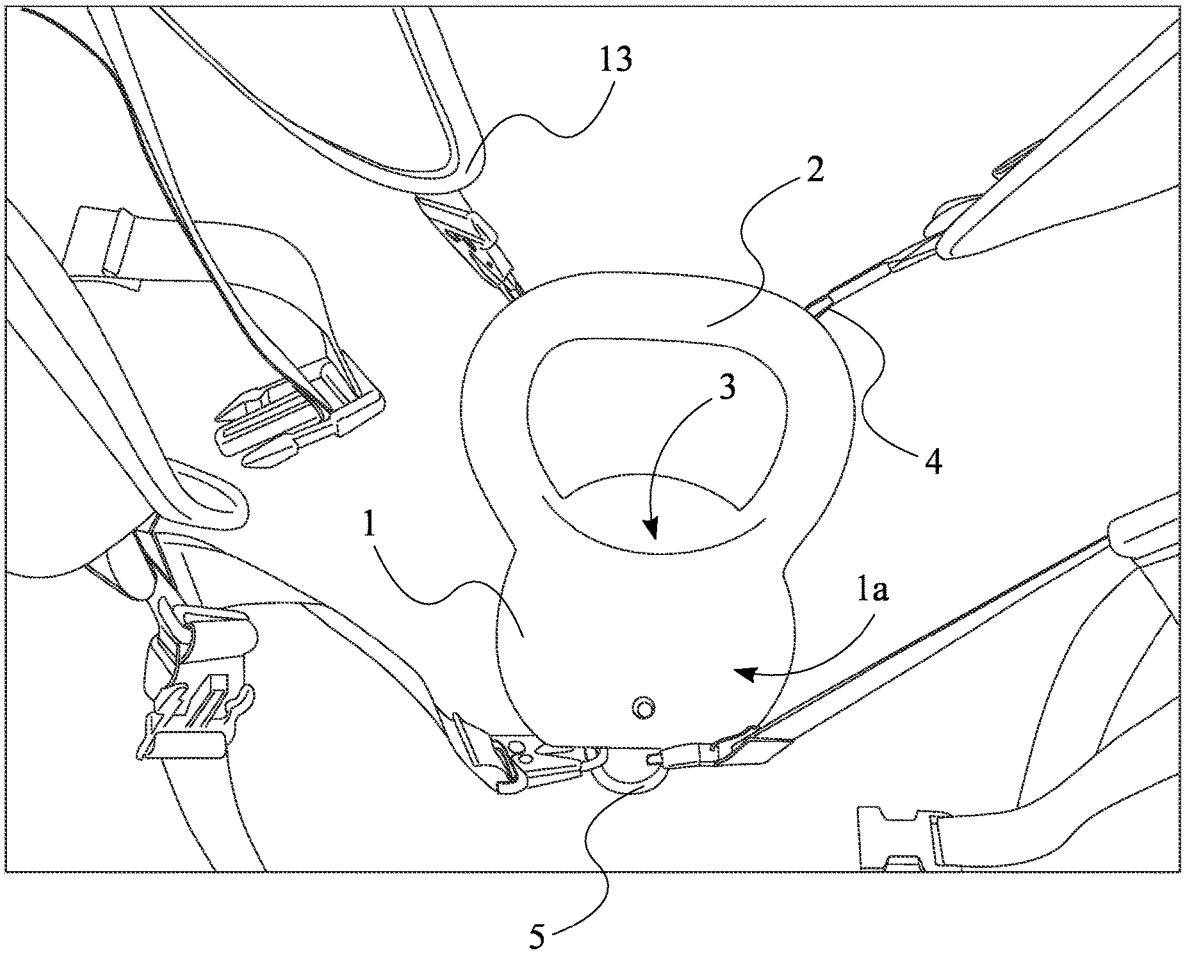
FIG. 13 is a perspective view of the strap accessory attached to the kettlebell.
Figure 14:
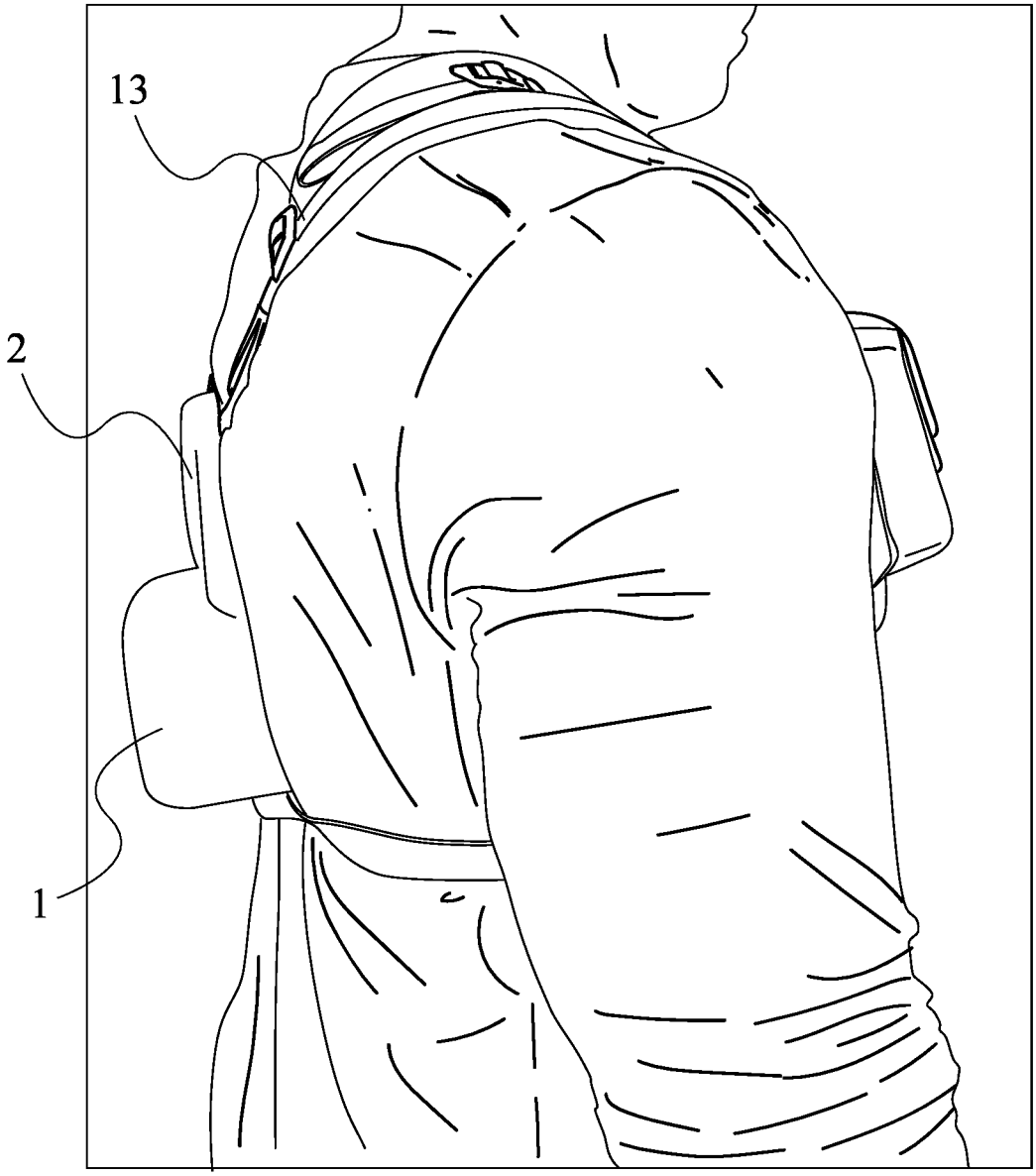
FIG. 14 is a perspective view demonstrating one of many positions on how the present invention may be utilized.

In reference to FIG. 13 and FIG. 14, the present invention is fully assembled with backpack straps 13 or strap accessories through the plurality of first fasteners 4 and the plurality of second fasteners 5. Note that the plurality of first fasteners 4 and the plurality of second fasteners 5 shown in FIG. 13 and FIG. 14 are for presentation purposes. The user of the present invention does not necessarily need to attach the first fastener 4 and the second fastener 5 simultaneously. The user can attach a single lower loop attachment depending on the type of exercise and movement the user wants to use the kettlebell for. One lower loop attachment is sufficient enough for heavy duty weight and/or force. Thus, the present invention is an upgraded kettle bell device that is multifunctional yet user-friendly.

Although the invention has been explained in relation to its preferred embodiment, it is to be understood that many other possible modifications and variations can be made without departing from the spirit and scope of the invention as hereinafter claimed.

What is claimed is:

1. A multifunctional kettlebell device comprising:
- a main body;
- a handle;
- a first indentation;
- a plurality of first fasteners;
- a plurality of second fasteners;
- the main body comprising a first surface and a second surface;
- each of the plurality of first fasteners comprising a metal loop;
- the first surface being positioned opposite to the second surface across the main body;
- the handle being mounted onto a first end of the main body;
- the first indentation tapering from the first end of the main body towards a second end of the main body, wherein the second end of the main body is positioned opposite to the first end across the main body;
- the first indentation being positioned on the first surface of the main body and in between terminal edges of the handle;
- the plurality of first fasteners being mounted onto the handle;
- the plurality of second fasteners being mounted onto a third surface of the main body; and
- the third surface being positioned adjacent the second end of the main body.

2. The multifunctional kettlebell device of claim 1, wherein the first surface, the second surface and the third surface are planar surfaces.

3. The multifunctional kettlebell device of claim 1, wherein the main body is hemispherical.

4. The multifunctional kettlebell device of claim 1 further comprising:
- a plurality of holes;
- the plurality of holes traversing through the handle;
- the plurality of holes being equidistant from a longitudinal central axis of the main body; and
- the plurality of first fasteners being threaded through the plurality of holes.

5. The multifunctional kettlebell device of claim 1 further comprising:
- a second indentation;
- a plurality of insertion slots;
- the second indentation being positioned on the third surface;
- the plurality of insertion slots extending into the main body from the second indentation towards the first end of the main body; and
- a first section of each of the plurality of second fasteners being mounted within the plurality of insertion slots.

6. The multifunctional kettlebell device of claim 5 further comprising:
- a second section of each of the plurality of second fasteners being positioned outside the plurality of insertion slots; and
- the second section being positioned opposite to the first section.

7. The multifunctional kettlebell device of claim 5 further comprising:
- a fastener canal;
- a third fastener;
- the fastener canal traversing from the first surface into the plurality of insertion slots;
- the fastener canal being positioned adjacent the second end of the main body;
- the third fastener being threaded through the fastener canal; and
- the third fastener securely fastening each of the plurality of second fasteners within a corresponding insertion slot, wherein the corresponding insertion slot is one of the plurality of insertion slots.

8. The multifunctional kettlebell device of claim 1, wherein each of the plurality of second fasteners comprises a D-ring.

9. The multifunctional kettlebell device of claim 1, wherein each of the plurality of second fasteners is rotatable.

10. The multifunctional kettlebell device of claim 1 further comprising:
- the handle comprising a gripping portion;
- the gripping portion comprising a first length;
- the second end of the main body comprising a second length; and
- the first length being greater than the second length.

11. A multifunctional kettlebell device comprising:
- a main body;
- a handle;
- a first indentation;
- a second indentation;
- a plurality of insertion slots;
- a plurality of first fasteners;
- a plurality of second fasteners;
- the main body comprising a first surface, a second surface, and a third surface;
- the first surface being positioned opposite to the second surface across the main body;
- the handle being mounted onto a first end of the main body;
- the first indentation tapering from the first end of the main body towards a second end of the main body, wherein the second end of the main body is positioned opposite to the first end across the main body;
- the first indentation being positioned on the first surface of the main body and in between terminal edges of the handle;
- the second indentation being positioned on the third surface;
- the plurality of insertion slots extending into the main body from the second indentation towards the first end of the main body;
- the plurality of first fasteners being mounted onto the handle;
- the plurality of second fasteners being mounted onto the third surface of the main body; and
- the third surface being positioned adjacent the second end of the main body.

12. The multifunctional kettlebell device of claim 11, wherein the first surface, the second surface and the third surface are planar surfaces.

13. The multifunctional kettlebell device of claim 11, wherein the main body is hemispherical.

14. The multifunctional kettlebell device of claim 11 further comprising:

a plurality of holes;

the plurality of holes traversing through the handle;

the plurality of holes being equidistant from a longitudinal central axis of the main body; and the plurality of first fasteners being threaded through the plurality of holes.

15. The multifunctional kettlebell device of claim 11 further comprising:

a first section of each of the plurality of second fasteners being mounted within the plurality of insertion slots;

a second section of each of the plurality of second fasteners being positioned outside the plurality of insertion slots; and the second section being positioned opposite to the first section.

16. The multifunctional kettlebell device of claim 11 further comprising:

a fastener canal;

a third fastener;

the fastener canal traversing from the first surface into the plurality of insertion slots;

the fastener canal being positioned adjacent the second end of the main body;

the third fastener being threaded through the fastener canal; and the third fastener securely fastening each of the plurality of second fasteners within a corresponding insertion slot, wherein the corresponding insertion slot is one of the plurality of insertion slots.

17. A multifunctional kettlebell device comprising:

a main body;

a handle;

a first indentation;

a second indentation;

a plurality of insertion slots;

a plurality of holes;

a plurality of first fasteners;

a plurality of second fasteners;

the main body comprising a first surface, a second surface, and a third surface;

the first surface being positioned opposite to the second surface across the main body;

the handle being mounted onto a first end of the main body;

the first indentation tapering from the first end of the main body towards a second end of the main body, wherein the second end of the main body is positioned opposite to the first end across the main body;

the first indentation being positioned on the first surface of the main body and in between terminal edges of the handle;

the second indentation being positioned on the third surface;

the plurality of insertion slots extending into the main body from the second indentation towards the first end of the main body;

the plurality of holes traversing through the handle;

the plurality of holes being equidistant from a longitudinal central axis of the main body;

the plurality of first fasteners being threaded through the plurality of holes;

the plurality of second fasteners being mounted onto the third surface of the main body; and the third surface being positioned adjacent the second end of the main body.

18. The multifunctional kettlebell device of claim 17 further comprising:

a first section of each of the plurality of second fasteners being mounted within the plurality of insertion slots;

a second section of each of the plurality of second fasteners being positioned outside the plurality of insertion slots; and the second section being positioned opposite to the first section.

19. The multifunctional kettlebell device of claim 17 further comprising:

a fastener canal;

a third fastener;

the fastener canal traversing from the first surface into the plurality of insertion slots;

the fastener canal being positioned adjacent the second end of the main body;

the third fastener being threaded through the fastener canal;

the third fastener securely fastening each of the plurality of second fasteners within a corresponding insertion slot, wherein the corresponding insertion slot is one of the plurality of insertion slots.

* * * * *